US005714934A

United States Patent [19]

Sasagawa et al.

[11] Patent Number: 5,714,934

[45] Date of Patent: Feb. 3, 1998

[54] SELF-CHECKING CABLE TYPE E.A.S. SYSTEM

[75] Inventors: Shinichi Sasagawa; Seishi Namioka; Nobuyuki Ichimiya; Shin Kinouchi, all of Miyagi-ken, Japan

[73] Assignee: Alps Electric Co., Ltd., Tokyo, Japan

[21] Appl. No.: 618,279

[22] Filed: Mar. 18, 1996

[30] Foreign Application Priority Data

Mar. 28, 1995 [JP] Japan ..... 7-069872

[51] Int. Cl.[6] ..... G08B 13/14

[52] U.S. Cl. ..... 340/568; 340/516; 340/572

[58] Field of Search ..... 340/568, 572, 340/516

[56] References Cited

U.S. PATENT DOCUMENTS

| | | | |
|---|---|---|---|
| 4,151,520 | 4/1979 | Full | 340/528 |
| 4,716,401 | 12/1987 | Wohlford et al. | 340/568 |
| 5,561,417 | 10/1996 | Rothbaum et al. | 340/568 |

*Primary Examiner*—Glen Swann

*Attorney, Agent, or Firm*—Guy W. Shoup; Patrick T. Bever

[57] ABSTRACT

An E.A.S. system capable of immediately making a decision on a broken condition of a tag 2 itself or its connection cable 8 or a non-connected condition of the connection cable 8 to a repeating device 1 at start-up of the system. The system comprises the repeating device 1 and a tag 2 detachably coupled through the connection cable 8 to the repeating device 1. The repeating device 1 is equipped with a jack 3 having a plug receiver 3a, a fixed contact 3b and a movable contact 3c, a pull-up resistor 4 coupled between the movable contact 3c and a power supply 10, a connection section for connecting the fixed contact 3b and the plug receiver 3a with a ground point, and a tag condition detecting section (5 to 7) coupled to the movable contact 3c. The tag 2 incorporates an internal resistor 2a, and a double pole plug 9 is detachably connected through the connection cable 8 with the jack 3. When the double pole plug 9 is separated from the jack 3, the movable contact 3c comes into contact with the fixed contact 3b, and when it is inserted into the jack 3, the movable contact 3c is separated from the fixed contact 3b.

4 Claims, 5 Drawing Sheets

SELF-CHECKING CABLE TYPE E.A.S. SYSTEM

BACKGROUND OF THE INVENTION

1. Field of the Invention

The present invention relates to an Electronic Article Surveillance System (hereinafter referred to as "E.A.S. System"), and more particularly, to an E.A.S. system which is for the purpose of monitoring pilferages or thefts of goods by monitoring, with a repeating or junction device, the condition of each of a plurality of tags attached to goods, goods packing boxes or the like, and which makes a decision on the condition of the tag itself and the condition of a connection cable by the repeating device at start-up of the system.

2. Description of the Prior Art

So far there has been developed an antipilferage system which is of the type in which a detection output is obtained from a tag attached to goods, goods packing boxes and others and is transmitted through a connection cable to a repeating device, which in turn monitors the occurrence of pilferages of goods on the basis of the variation of the detection output from the tag.

FIGS. 4 to 6 are illustrations available for describing one example of an arrangement of a developed and known E.A.S. system. Of these figures, FIG. 4 is a schematic illustration of the whole arrangement of the known E.A.S. system, FIG. 5 is a cross-sectional view showing a tag to be used for the known E.A.S. system, and FIG. 6 is an illustration of a circuit arrangement of a tag and a repeating device to be used for the known E.A.S. system.

As shown in FIG. 4, a plurality of tags 51 are respectively attached to goods packing boxes 53 accommodating goods 52 and connected through connection cables 54 to a tag connection section (not shown in FIG. 4) of a repeating device 55. This repeating device 55 is equipped with a detection section 56 and an alarm section 57, and the detection section 56 accommodates the aforesaid tag connection section.

Further, as shown in FIG. 5, each of the tags 51 is composed of a first disc-like case or cover 58 having a flat base portion and an internal space portion, a cylindrical section 59 protruding from a center of the base portion of the first case 58, and a second dome-like case or cover 60 having an internal space portion, with the first and second cases 58 and 60 being fixedly engaged with each other. A circuit substrate 61 is placed in the space sections of the first and second cases 58, 60, and further, a phototransistor 62 is located on or in the tip portion of the cylindrical section 59. To the circuit substrate 61 there are connected lead wires 621 of the phototransistor 62 and the connection cables 54, and further transistors and resistors (not shown in FIG. 5). For attaching the tag 51 to the goods packing box 53, the tip portion 62t of the phototransistor 62 placed on the cylindrical section 59, together with the cylindrical section 59, is fitted and inserted into the goods packing box 53 and the tag 51 is then adhered to the goods packing box 53 through double adhesive tape 63 adhered to the base portion of the first case 58.

Moreover, as shown in FIG. 6 each of the tags 51 is made up of the phototransistor 62, a transistor 64 and two resistors (not designated with a numeral), and connected through the connection cables 54 to the tag connection section (not designated with numerals) of the repeating device 55. The detection section 56 of the repeating device 55 is equipped with a separate tap detection circuit 70 comprising a differentiating circuit 65, first and second decision circuits 66, 67, and first and second integrating circuits 68, 69, and is further provided with a common detection circuit 74 comprising a latch circuit 71, a rectangular-wave generating circuit 72, and a switching circuit 73. The alarm section 57 in the repeating device 55 is equipped with a buzzer BZ.

The outline of the operation of the known E.A.S. system with the aforesaid arrangement is as follows. That is, when the cylindrical section 59 of the tag 51 is inserted into the goods packing box 52 in a store, the phototransistor 62 disposed on the tip portion of the cylindrical section 59 hardly senses light, and hence the current flowing through the phototransistor 62 becomes extremely little. At this time, in the detection section 56, the output voltage of the differentiating circuit 65 becomes large, and the output voltage of the first decision circuit 66 is fed through the first integrating circuit 68 to the latch circuit 71 to reset the latch circuit 71. Further, the reset output of the latch circuit 71 causes a rectangular-wave signal with a positive polarity to be produced from the rectangular-wave generating circuit 72, thereby setting the switching circuit 73 to the off condition. Accordingly, the detection section 56 does not supply any signal to the alarm section 57 and hence the buzzer BZ does not work.

In this state, if the tag 51 inserted into the goods packing box 53 is removed therefrom or if the goods packing box 53 is broken, since the phototransistor 62 is responsive to the illuminating light in the store or the light coming from the exterior, the current flowing through the phototransistor 62 increases. At this time, in the detection section 56, the output voltage of the differentiating circuit 65 sharply drops, and the output voltage of the second decision circuit 67 is applied through the second integrating circuit 69 to the latch circuit 71 so that the latch circuit 71 gets into the set condition. In addition, the set output of the latch circuit 71 causes a rectangular-wave signal with a negative polarity to be generated from the rectangular-wave generating circuit 72 so that the switching circuit 73 comes into the on condition. Thus, the detection section 56 supplies a driving signal to the alarm section 57 so that the buzzer sounds the alarm, with the result the salesclerks can know the fact that an abnormality occurred in respect of the tag 51 inserted into the goods packing box 53. Further, the buzzer BZ sounds the alarm not only in the case that the tag 51 is removed from the goods packing box 53 or the goods packing box 53 is broken but also in the case where the connection cable 54 of the tag 51 becomes short-circuited as a result of being subjected to a strong force or the connection cable 54 is cut off.

As described above, according to this known E.A.S. system, in a case in which the tag 51 or the parts related to the tag 51 change from the original condition, the buzzer always issues the alarm sounds to inform the salesclerks of the abnormality of the tag 51.

Since the known E.A.S. system is designed to detect a variation of the tag 51 condition and issue an alarm through the buzzer BZ in cases such as when the tag 51 attached to the goods or the goods packing box is taken down therefrom, the goods packing box 53 is broken, the connection cable 54 of the tag 51 becomes short-circuited, or when the connection cable 54 is cut off, the E.A.S. system can have an extremely high reliability.

On the other hand, since the known E.A.S. system is used in a state where the tag 51 is attached to the goods 52 or the goods packing box 53, the goods or the goods packing box 53 are frequently transferred in a state in which the tag 51 is attached thereto, and the connection cable 54 connected to the tag 51 is thus exposed to various vibrations while being transferring, with the result that the cut-off of the connection cable 54 becomes liable to occur.

Furthermore, in the case of the known E.A.S. system, when the tag 51 is attached to the goods 52 or the goods packing box 53, if the tag 51 itself or its connection cable 54 is damaged from the beginning or if the connection cable 54 of the tag 51 is not yet connected with the repeating device 55, the resistance value of the tag 51 becomes close to the infinity when viewed from the detection section 56 side. These conditions are identical to the initial condition in which a normal tag 51 is attached to the goods 52 or the goods packing box 53.

That is, since the know E.A.S. system is made to detect a variation of the condition of the attached tag 51 and issue an alarm, the system can not accurately distinguish among the case in which the tag 51 itself or its connection cable 54 is damaged from the beginning, the case in which the connection cable 54 of the tag 51 to be attached thereto is not connected with the repeating device 55, and the case in which the tag 51 which is in the normal condition is fitted to the goods 52 or the goods packing box 53. Accordingly, in the case in which the tag 51 itself or the connection cable 54 thereof is broken or in the case that the connection cable 54 of the tag 51 attached is not connected with the repeating device 55, there is a problem which arises with the known E.A.S. system in that difficulty is encountered in detecting the fact that the tag 51 is removed therefrom.

SUMMARY OF THE INVENTION

The present invention has been developed with a view to eliminating the aforesaid problem, and it is therefore an object of the present invention to provide an E.A.S. system which is capable of immediately making a decision, at the system start-up, on the state of the tag itself or whether the connection cable is broken and the state in which the connection cable is not in connection with the repeating device.

For this purpose, in accordance with the present invention, an E.A.S. system comprises a repeating device and at least one tag detachably connected through a connection cable to the repeating device, the repeating device including a jack having a plug receiver, a fixed contact and a movable contact, a pull-up resistor connected between the movable contact and one end of a power supply, connection means for connecting the fixed contact, together with the plug receiver, to the other end of the power supply, and tag condition detecting means connected with the movable contact, in relation to each tag, with the tag having an internal resistor with a finite resistance value, and further comprises a detachable type double pole plug connected through the connection cable to the jack and means for causing the movable contact to come into contact with the fixed contact when the double pole plug is separated from the jack and for causing the movable contact to separate from the fixed contact when the double pole plug is inserted into the jack.

With this arrangement, the E.A.S. system comprises the repeating device and one or more tags detachably connected through the connection cable to the repeating device, and on the repeating device side, in correspondence with each tag there are provided the jack having the plug receiver, the fixed contact and the movable contact, the pull-up resistor coupled between the movable contact and the power supply and the tag condition detecting means coupled to the movable contact while on the tag side there is provided the internal resistor and the double pole plug connected with the connection cable. When the tag is connected through the connection cable to the repeating device, the tip portion of the double pole plug presses the movable contact to separate the movable contact from the fixed contact so that the power supply voltage applied through the pull-up resistor to the movable contact is divided by the pull-up resistor and the internal resistor of the tag. A preset voltage attained by the voltage division is applied to the tag condition detecting means.

When detecting at the time of the start-up of the E.A.S. system the fact that the division voltage obtained at the movable contact of one jack becomes substantially equal to a preset voltage between the power supply voltage and the ground voltage, the tag condition detecting means indicates or displays that the double pole plug is inserted into the jack and the tag itself is connected with the double pole plug and the connection cable are in the normal conditions, thereafter the E.A.S. system comes into operation. Further, in a case where the tag is simply removed from the goods or the goods packing box during the operation of the E.A.S. system, the preset voltage varies greatly toward the power supply voltage. On the other hand, in the case in which the tag is removed from the goods or the goods packing box, since the preset voltage varies greatly toward the ground voltage if the connection is a short-circuited, the tag condition detecting means can sense the variation and will always monitor the tag condition.

Furthermore, when at the start-up of the E.A.S. system the tag condition detecting means detects that the division voltage obtained at the movable contact of one jack is substantially equal to the power supply voltage, the tag condition detecting means indicates that, although the double pole plug has been inserted into the jack, either the tag itself or the connection cable is broken. When this indication is made, the tag connected to the jack and the connection cable are replaced with new ones, and subsequently, the tag condition detecting means confirms as described above, that the tag and connection cable replaced are normal, whereupon the E.A.S. system comes into operation.

Moreover, when detecting, at the start-up of the E.A.S. system, that the division voltage obtained at the movable contact of one jack is substantially equal to the ground voltage, the tag condition detecting means indicates that the double pole plug has not yet been inserted into the jack. When such an indication is made, naturally the double pole plug is inserted into the jack, and then the tag condition detecting means confirms, as described before, that the tag connected and the connection cable are in the normal conditions, whereupon the E.A.S. system starts its operation.

Thus, according to the above-mentioned arrangement, at the start-up of the E.A.S. system the divided voltage obtained at the movable contact of the jack is fed to the tag condition detecting means which in turn immediately monitors the presence or absence of damage or the breakdown of the tag itself, or the connection cable, and the presence or absence of the non-connected state of the connection cable to the repeating device on the basis of the value of the divided voltage, and the decision results are indicated. Thus, it is possible to prevent such a case that the tag does not work for monitoring the pilferage, and hence to provide an E.A.S. system with higher reliability.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
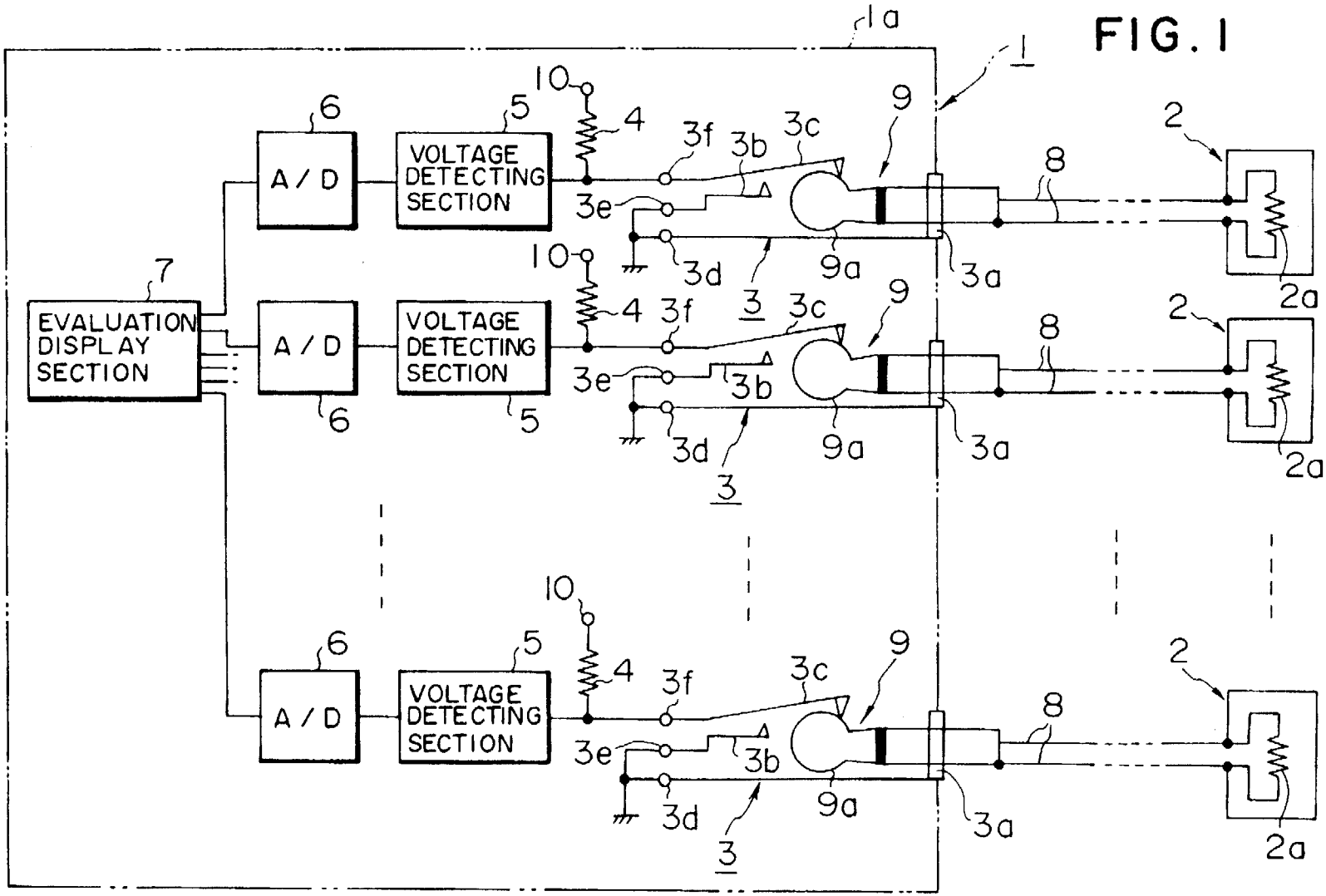
FIG. 1 is a block diagram showing an arrangement of a principal section of an E.A.S. system according to an embodiment of the present invention.

Referring now to the drawings, a description will be made hereinbelow of an embodiment of the present invention. FIG. 1 is a block diagram showing an arrangement of a principal section of an E.A.S. system according to an embodiment of the present invention, and FIGS. 2A and 2B are illustrations available for explaining an arrangement of a jack for use in the E.A.S. system shown in FIG. 1, FIG. 2A showing a state in which a double pole plug is not inserted thereinto and FIG. 2B illustrating a state in which the double pole plug is inserted thereinto.

Figure 5:
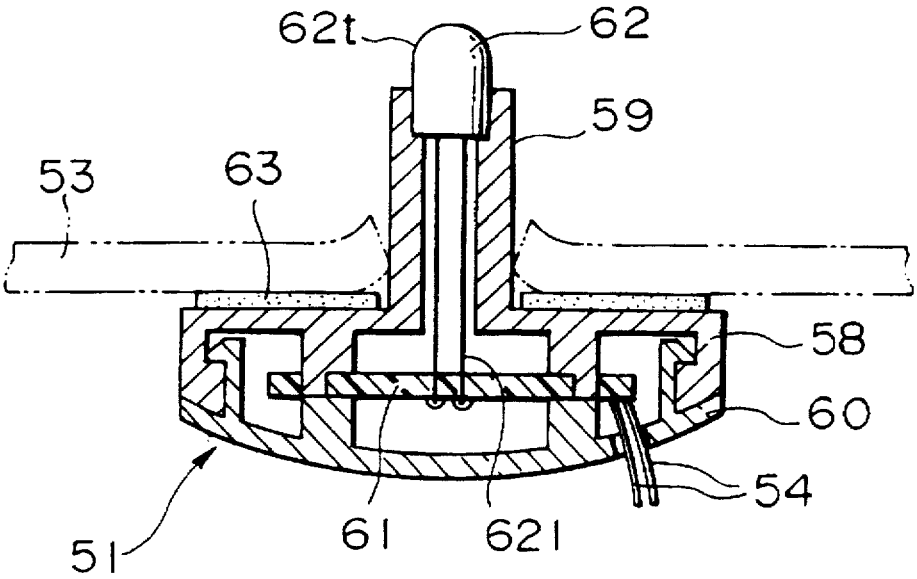
FIG. 5 PRIOR ART
FIG. 5 is a cross-sectional view showing a tag to be used for the known E.A.S. system shown in FIG. 4.
Figure 6:
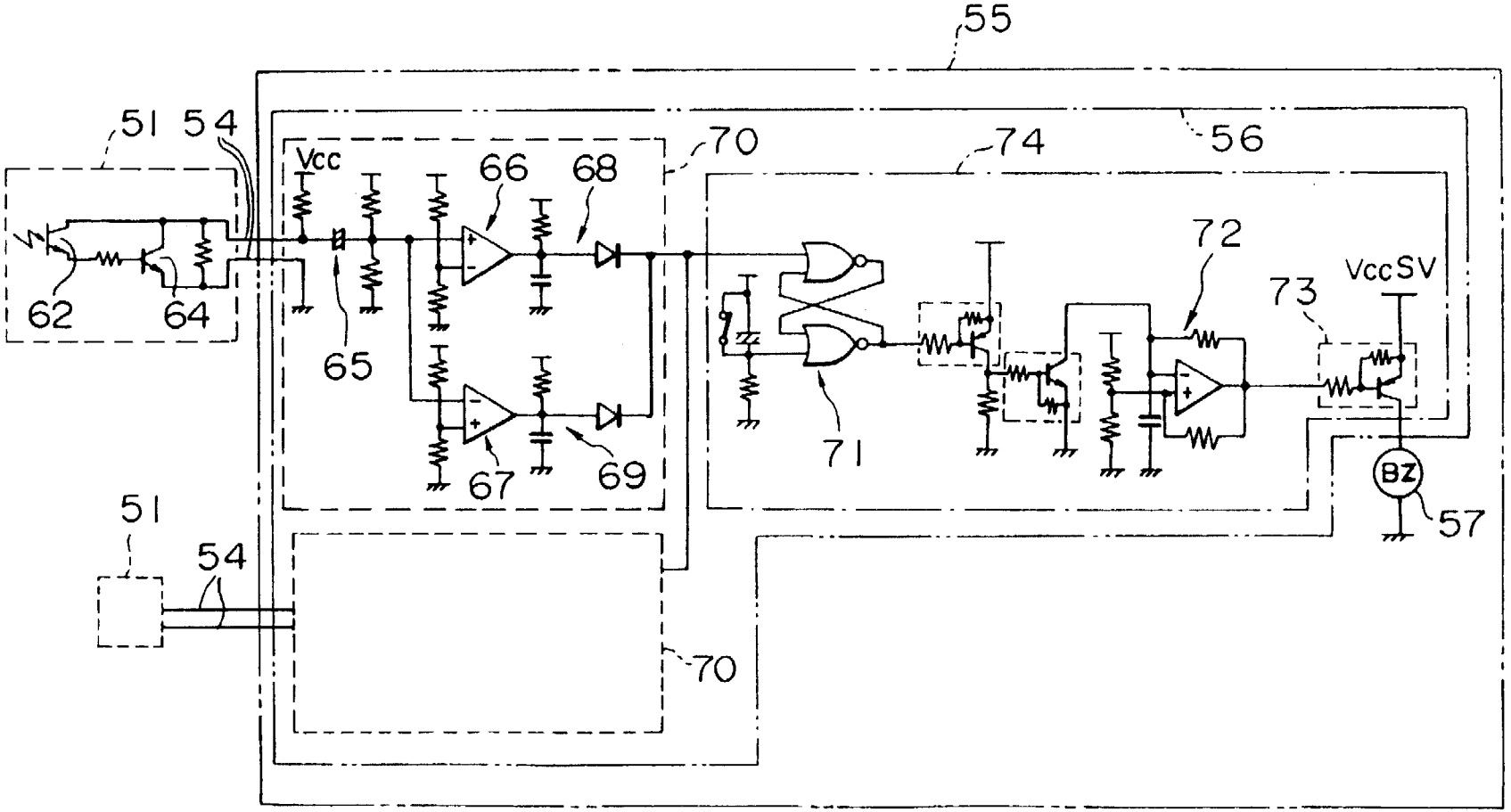
FIG. 6 PRIOR ART
FIG. 6 is an illustration of a circuit arrangement of the tag and a repeating device for use in the known E.A.S. system shown in FIG. 4.

As shown in FIG. 1, the E.A.S. system according to this embodiment comprises a repeating device 1 and a plurality of tags 2 detachably connected with the repeating device 1. The repeating device 1 is composed of a plurality of jacks 3 fitted to a case 1*a*, a plurality of pull-up resistors 4, a plurality of voltage detecting sections 5, a plurality of analog-to-digital converters (A/D) 6, and one evaluation display (indicating) section 7. Of these parts, the voltage detecting section 5, the analog-to-digital converter 6 and the evaluation display section 7 make up a tag condition detecting means. In this case, the evaluation display section 7 is constructed with a microcomputer (not shown) and a display section (not shown), the microcomputer has an internal memory storing as a preset voltage a value taken when a digital detection voltage to be inputted is normal. Each of the plurality of tags 2 has the same structure as that shown in FIGS. 4 to 6, and also has an internal resistor 2*a* with a finite resistance value. A pair of connection cables 8 extend from both ends or terminals of the internal resistor 2*a*, and the other ends of the connection cables 8 come into connection with a double pole plug 9.

Furthermore, each of the plurality of lacks 3 is equipped with a plug receiver 3*a*, a fixed contact 3*b*, a movable contact 3*c*, a first terminal 3*d* connected with the plug receiver 3*a*, a second terminal 3*e* connected with the fixed contact 3*b*, and a third terminal 3*f* connected with the movable contact 3*c*. The plug receiver 3*a* detachably accommodates the double pole plug 9. Each of the plurality of the pull-up resistors 4 is placed between a power supply terminal 10 and the third terminal 3*f* of the corresponding jack 3, and the first and second terminals 3*d*, 3*e* of each jack 3 are connected with each other and then coupled to a ground voltage point. Further, each of the plurality of voltage detecting sections 5 is in connection with the third terminal 3*f* of the corresponding jack 3, and each of the plurality of analog-to-digital converters 6 is in connection with an output side of the corresponding voltage detecting section 5. Moreover, the common evaluation display section 7 is in connection with the outputs of the respective analog-to-digital converters 6.

Figure 2A:
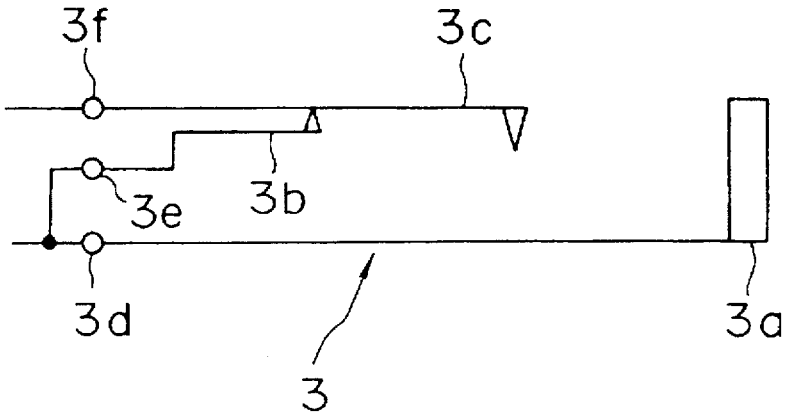
FIGS. 2A and 2B are illustrations available for explaining an arrangement of a jack for use in the E.A.S. system shown in FIG. 1.
Figure 2B:
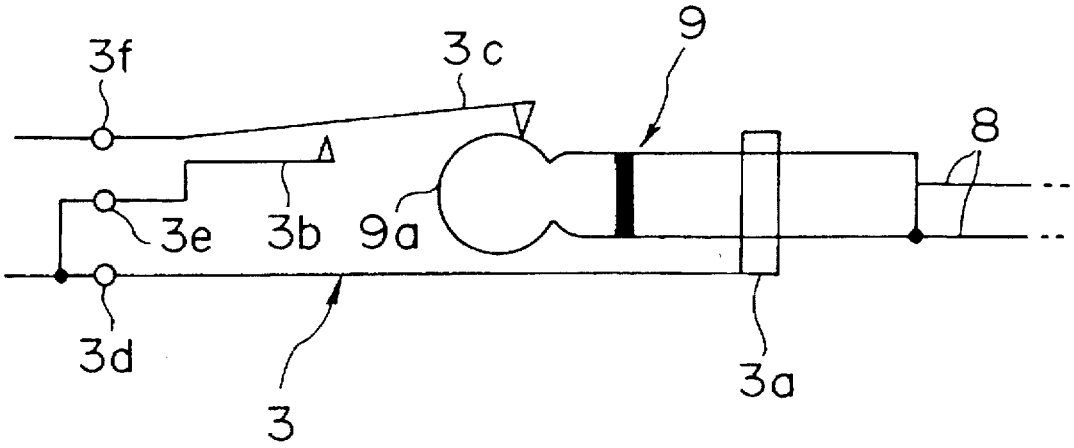

Still further, each jack 3 is made such that its movable contact 3*c* comes into contact with the mating fixed contact 3*b* due to an action of a spring as shown in FIG. 2A when the double pole plug 9 is not inserted into the mating plug receiver 3*a* while, when the double pole plug 9 is inserted into the plug receiver 3*a*, as shown in FIG. 2B, a tip portion 9*a* of the double pole plug 9 presses the movable contact 3*c* upwardly against the action of the spring so that the movable contact 3*c* separates from the fixed contact 3*b*.

Figure 3:
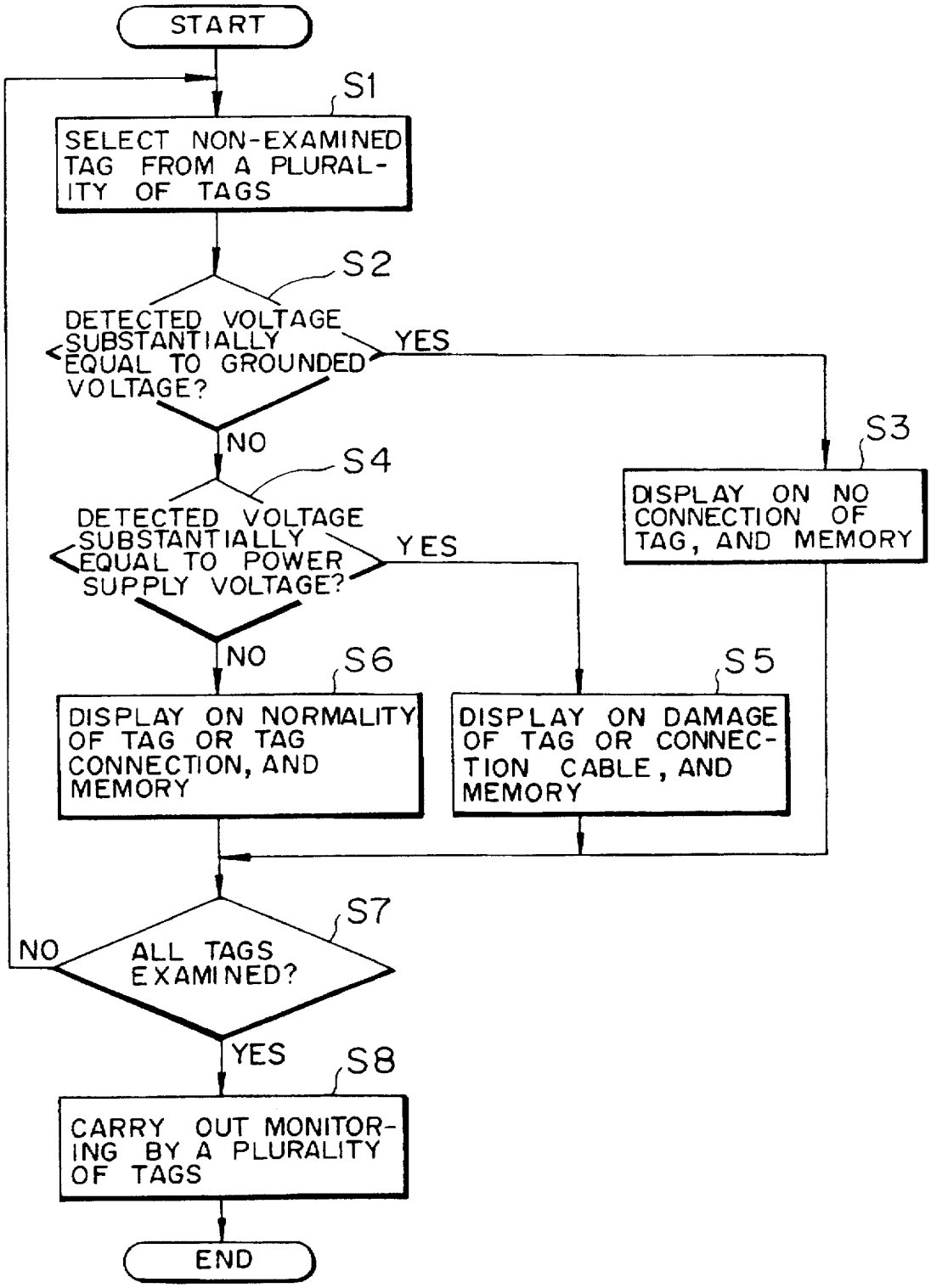
FIG. 3 is a flow chart showing an operation of the FIG. 1 E.A.S. system at its start-up.

Secondly, an operation of the E.A.S. system according to this embodiment will be described hereinbelow with reference to the flow chart of FIG. 3.

Figure 4:
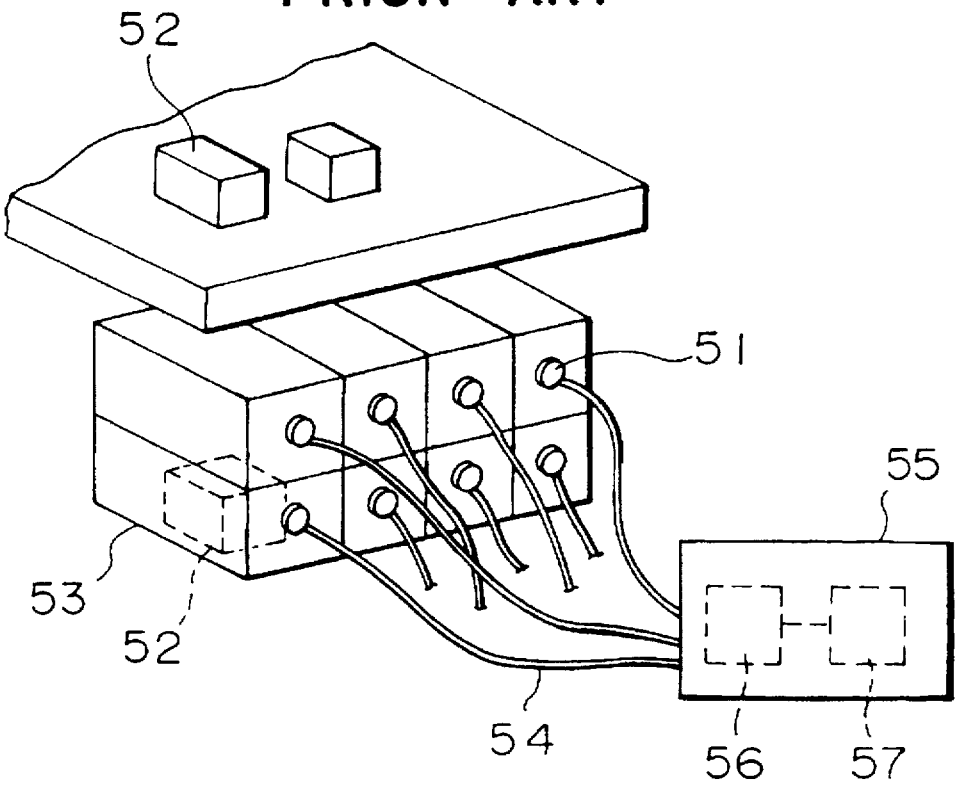
FIG. 4 PRIOR ART
FIG. 4 is a schematic illustration of the whole arrangement of a known E.A.S. system.

First of all, prior to starting the operation of the E.A.S. system, as shown in FIG. 4, each of the tags 2 is attached to the goods, the goods packing box or the like to be placed under monitoring, and subsequently the double pole plug 9 coupled with the other ends of the connection cables 8 of the tag 2 is inserted into the corresponding jack 3 fitted to the case 1*a* of the repeating device 1. After the attachment of the tag 2 to the goods or the goods packing box and the insertion of the double pole plug 9 into the jack 3, the power supply is made to connect with this E.A.S. system, i.e., the repeating device 1, by which connection the E.A.S. system starts its operation.

When the repeating device enters the starting condition, the power supply voltage Vcc from the power supply terminal 10 is applied to the movable contact 3*c* of each of the jacks 3, that is, applied through the pull-up resistor 4 to the third terminal 3*f* thereof. At this time, the voltage Vd developed at the third terminal 3*f* depends upon the resistance value between the third terminal 3*f* and the first terminal 3*d* or the second terminal 3*e*, i.e., the resistance value when the connection cable 8 side is viewed from the double pole plug 9. If the resistance value from the double pole plug 9 side toward the connection cable 8 side is approximately equal to the value of the internal resistor 2*a* of the tag 2, the voltage Vd comes to the division voltage obtained by dividing the power supply voltage Vcc by the resistance value of the pull-up resistor 4 and the resistance value of the internal resistor 2*a*. Further, this division voltage Vd is detected by the corresponding voltage detecting section 5 and then is converted into a digital detection voltage in the corresponding analog-to-digital converter 5, before being supplied to the evaluation display section (microcomputer) 7. In this state, the E.A.S. system executes the following steps S1 to S9.

First, in step S1 the evaluation display section (microcomputer) 7 chooses one tag, for example the uppermost tag 2 in the illustration, of the plurality of tags 2 which are in connected relation to the repeating device 1. At this time, the evaluation display section (microcomputer) 7 chooses the digital detection voltage due to the tag 2 from a plurality of digital detection voltages and abandons the other digital detection voltages.

Subsequently, in step S2 the evaluation display section (microcomputer) 7 monitors whether or not the digital detection voltage chosen in step S1 is substantially equal to the ground voltage. If the answer is YES (Y), i.e., that it is generally equal to the ground voltage, the operation advances to step S3. On the other hand, if the decision is NO (N), i.e., that it is not generally equal thereto, the operation proceeds to step S4.

In step S3, since the chosen and inputted digital detection voltage is generally equal to the ground voltage, the evaluation display section (microcomputer) 7 decides that the fixed contact 3*b* and the movable contact 3*c* are in contact with each other, that is, the tag 2 is in a non-connected relation to the jack 3, because the double pole plug 9 is not normally inserted into the plug receiver 3*a* of the jack 3, and hence indicates no connection of the tag 2 on a display section connected to the microcomputer and concurrently stores the same contents in its internal memory.

Going the other way, in step S4 the evaluation display section (microcomputer) 7 decides whether or not the digital detection voltage chosen in step S1 is generally equal to the power supply voltage Vcc. If the decision is YES (Y), i.e., that it is generally equal to the power supply voltage Vcc, the operational flow goes to step S5. On the other hand, if the decision is NO (N), i.e., that it is not generally equal thereto, the operational flow advances to a different step S6.

In step S5, since the chosen and inputted digital detection voltage is generally the same as the power supply voltage Vcc, the evaluation display section (microcomputer) 7 decides that, although the double pole plug 9 is normally inserted into the plug receiver 3*a* of the jack 3, the resistance value between the poles of the double pole plug 9 is substantially infinite, that is, the tag 2 itself coupled to the double pole plug 9 is in a broken condition or the connection cable 8 is in a disconnected condition, and hence indicates the contents to that effect, that the tag 2 or the connection cable 8 is broken, on the display section coupled to the microcomputer and at the same time stores the same contents in its internal memory.

Going the other way, in step S6, since the chosen and inputted digital detection voltage is not generally the same as the ground voltage or the power supply voltage Vcc, the evaluation display section (microcomputer) 7 decides that the voltage at the third terminal 3*f* of the jack 3 assumes the division voltage created by dividing the power supply voltage Vcc with the resistance value of the pull-up resistor 4 and the resistance value of the internal resistor 2*a*, that is, the double pole plug 9 is normally inserted into the plug receiver 3*a* of the jack 3 in addition to the connection cables 8 and tag 2 connected to the double pole plug 9 being also in the normal conditions, and indicates the contents to that effect, that the tag 2 and its connection states are in the normal conditions, on the display section coupled to the microcomputer and simultaneously stores the same contents in its internal memory.

Thereafter, in step S7 the evaluation display section (microcomputer) 7 monitors whether or not all the tags 2 connected to the repeating device 1 have been chosen and the chosen tags 2 have undergone the examination by steps S2 to S6. When the answer is YES (Y), that is, when all the tags 2 have been chosen and the examination is made therefor, the operational flow advances to step S8. On the other hand, when there exists at least one non-chosen and non-examined tag 2, that is, when the answer is NO (N), the operational flow returns to the first step S1 in which another tag, for example the tag next to the upmost tag in the illustration, is chosen from the plurality of tags 2 coupled to the repeating device 1, and subsequently, step S2 and the following steps are again executed in terms of the chosen tag 2.

In step S3, if there is a tag 2 indicated as being non-connected thereto, the double pole plug 9 coupled to that tag 2 is inserted into the corresponding jack 3. Further, in step S5, if there is the tag 2 indicated as being broken or as having a broken connection cable 8, that tag 2 is replaced with a new one and the new tag 2 is connected therewith, and thereafter the execution of the operation between steps S1 and step S6 is again necessary. In this case, the additional operation can be carried out immediately after that indication or can also be performed continuously after the completion of the operation from step S1 to step S6.

Moreover, in step S8 the evaluation display section (.microcomputer) 7 chooses all the tags 2 being in connecting relation to the repeating device 1 and monitors the digital detection voltages from all of the chosen tags 2. In this case, in a state where the tag 2 is attached to the goods or the goods packing box, the resistance value of the internal resistor 2*a* of the tag 2 is relatively small, and the digital detection voltage to be supplied to the evaluation display section (microcomputer) 7 approaches the preset voltage stored in the built-in memory. At this time, if the tag 2 is simply or merely taken down from the goods or the goods packing box, the resistance value of the internal resistor 2*a* of the tag 2 sharply rises, and hence the digital detection voltage to be fed to the evaluation display section (microcomputer) 7 considerably shifts toward the power supply voltage Vcc side relative to the preset voltage stored in the built-in memory. In addition, if the connection cable 4 falls into the short-circuited condition when the tag 2 is removed from the goods or the goods packing box, the digital detection voltage to be delivered to the evaluation display section (microcomputer) 7 considerably shifts toward the ground voltage side relative to the preset voltage stored in the built-in memory.

For these reasons, the evaluation display section (microcomputer) 7 successively performs the comparison of all the digital detection voltages supplied with the preset voltage stored in the built-in memory. When the comparison results show that all the digital detection voltages supplied are generally equal to the preset voltage, a decision is made that all the tags 2 are in the normal condition, and hence the alarm such as a buzzer is not activated. On the other hand, when in any of the supplied digital detection voltages there is a voltage which considerably shifts toward the power supply voltage Vcc relative to the preset voltage or there is a voltage which considerably shifts toward the ground voltage relative thereto, a decision is made that the tag 2 which supplies that digital detection voltage is in an abnormal condition, and hence an alarm such as a buzzer immediately actuates to inform the salesclerks of the fact that the goods or goods packing box related to that tag 2 is in an abnormal condition.

As described above, according to this embodiment, in terms of the plurality of tags 2 respectively coupled to the repeating device 1, at the turning-on (start-up) of the power supply of the E.A.S. system, the successive examination is made on the connecting conditions to the repeating device 1 and the breakdown conditions of the tags themselves and the connection cables 8. Thus, it is possible to surely detect whether the tag 2 coupled to the repeating device 1 has been removed from the goods or the goods packing box, thus providing an E.A.S. system with higher reliability.

Further, as described above in detail, according to this invention, at the turning-on (start-up) of the power supply of the E.A.S. system, the division voltages obtained at the movable contacts 3*c* (the third terminal 3*f*) of the plurality of jacks 3 provided in the repeating device 1 are respectively fed to the tag condition detecting means comprising the voltage detecting sections 5, the analog-to-digital converters 6 and the evaluation display section 7, and the tag condition detecting means immediately decides on the basis of each of the value of the supplied division voltages whether or not the tags 2 themselves or the connection cables 8 are broken and the connection cables 8 are coupled to the repeating device 1, and displays the decision results. Accordingly, it is possible to certainly prevent the possibility that the tags 2 are not useful against pilferages or thefts, thus providing an E.A.S. system with higher reliability as compared with the known E.A.S. systems.

It should be understood that the foregoing relates to only a preferred embodiment of the present invention, and that it is intended to cover all changes and modifications of the embodiment of the invention herein used for the purposes of this disclosure, which do not constitute departures from the spirit and scope of the invention. For example, although in the above-described embodiment the other end of the pull-up resistor 4 is connected to the power supply terminal 10 and the fixed contact 3*b* of the jack 3 is coupled to the ground potential point, it is also appropriate that the other end of the pull-up resistor 4 is connected with the ground potential point and the fixed contact 3*b* of the jack 3 is coupled to the power supply terminal 10.

What is claimed is:

1. An E.A.S. system comprising:

a repeating device including:

a jack having a plug receiver, a fixed contact and a movable contact;

a pull-up resistor connected between said movable contact and one end of a power supply;

connection means for connecting said fixed contact, together with said plug receiver, with the other end of said power supply; and tag condition detecting means connected with said movable contact;

at least one tag detachably connected through a connection cable to said repeating device, said tag having an internal resistor with a finite resistance value; and a detachable-type double pole plug connected through said connection cable to said jack, wherein said movable contact contacts said fixed contact when said double pole plug is separated from said jack, and said movable contact separates from said fixed contact when said double pole plug is inserted into said jack.

2. An E.A.S. system as defined in claim 1, wherein said tag condition detecting means includes:

a voltage detecting section for detecting a voltage at said movable contact;

an analog-to-digital converting section for converting a detection output of said voltage detecting means into a digital form; and an evaluation display section for evaluating and displaying an output of said analog-to-digital converting section.

3. An E.A.S. system as defined in claim 1, wherein said tag condition detecting means includes:

a voltage detecting section for detecting a voltage across said pull-up resistor;

an analog-to-digital converting section for converting a detection output of said current detecting section; and an evaluation display section for evaluating and displaying an output of said analog-to-digital converting section.

4. An E.A.S. system as defined in claim 1, wherein either the one end or other end of said power supply serves as a reference potential point.

* * * * *